US006663542B1

(12) United States Patent
Trabbic

(10) Patent No.: US 6,663,542 B1
(45) Date of Patent: Dec. 16, 2003

(54) ADJUSTABLE, BODY CIRCUMFUSION BARBELL WITH OFF-CENTERLINE MOMENT AND ROTATING GRIP

(76) Inventor: Michael Jon Trabbic, 4640 Chatterton Cir., Indianapolis, IN (US) 46254

( * ) Notice: Subject to any disclaimer, the term of this patent is extended or adjusted under 35 U.S.C. 154(b) by 11 days.

(21) Appl. No.: 10/186,567

(22) Filed: Jun. 28, 2002

(51) Int. Cl.[7] ..... A63B 21/072

(52) U.S. Cl. ..... 482/106; 482/98; 482/139

(58) Field of Search ..... 482/93, 94, 97, 482/98, 106–108, 104, 139, 140; D21/673, 679, 681, 682

(56) References Cited

U.S. PATENT DOCUMENTS

| | | | | | |
|---|---|---|---|---|---|
| 4,832,334 | A | * | 5/1989 | Mullen | 482/106 |
| 5,050,868 | A | * | 9/1991 | Pearson | 482/94 |
| D320,636 | S | * | 10/1991 | Eckler | D21/681 |
| 5,674,162 | A | | 10/1997 | Ellingson et al. | |
| 5,679,105 | A | * | 10/1997 | Vittone et al. | 482/93 |
| 5,741,206 | A | | 4/1998 | Anastasi | |
| 5,836,858 | A | * | 11/1998 | Sharff | 482/106 |
| 6,004,245 | A | * | 12/1999 | Boos | 482/93 |
| 6,010,439 | A | * | 1/2000 | Bullard, Jr. | 482/106 |
| 6,022,300 | A | | 2/2000 | Hightower | |
| 6,142,918 | A | | 11/2000 | Liu | |
| D437,015 | S | | 1/2001 | Rojas et al. | |
| 6,196,951 | B1 | | 3/2001 | Shepherd | |
| 6,217,494 | B1 | * | 4/2001 | Sandoval | 482/106 |
| 6,228,002 | B1 | | 5/2001 | Dantolan | |
| 6,572,515 | B2 | * | 6/2003 | De La Garza | 482/106 |

FOREIGN PATENT DOCUMENTS

| | | | | | |
|---|---|---|---|---|---|
| CH | 683967 | | * | 6/1994 | 482/108 |
| DE | 223926 | A1 | * | 6/1985 | 482/106 |
| DE | 29902222 | U1 | * | 4/1999 | 482/108 |
| JP | 40 9-206404 | A | * | 8/1997 | 482/106 |
| SU | 1818115 | | * | 5/1993 | 482/106 |

* cited by examiner

*Primary Examiner*—Jerome W. Donnelly
*Assistant Examiner*—Victor Hwang
(74) *Attorney, Agent, or Firm*—John D. Gugliotta; P. Jeff Martin

(57) ABSTRACT

An adjustable, body circumfusion barbell with off-centerline moment and rotating grip is provided for facilitating correct anatomical relationships and positioning while weight training. The apparatus serves not only to allow one to derive maximum benefits when training, but also serves to avert injury. The adjustable, body circumfusion barbell with off-centerline moment and rotating grip includes a barbell defining a first countermoment end, an intermediate moment segment, and a second countermoment end. The first and second countermoment end each have weight supporting means and rotating, knurled hand grips. The intermediate moment segment includes an elongated, laterally adjustable trave perpendicularly mounted in an offset manner between a pair of extension members. The intermediate moment segment provides a window for accommodating users of various torso sizes.

11 Claims, 7 Drawing Sheets

ADJUSTABLE, BODY CIRCUMFUSION BARBELL WITH OFF-CENTERLINE MOMENT AND ROTATING GRIP

RELATED APPLICATIONS

The present invention was first described in Disclosure Document Registration No. 478,619 filed on Aug. 28, 2000 under 35 U.S.C. §122 and 37 C.F.R. §1.14. There are no previously filed, nor currently any co-pending applications, anywhere in the world.

BACKGROUND OF THE INVENTION

1. Field of the Invention

The present invention relates generally to exercise equipment and, more particularly, to an adjustable, body circumfusion barbell with off-centerline moment and rotating grip.

2. Description of the Related Art

Today, society has never before had such a heightened consciousness for keeping fit through exercise. Various devices, machines, and methods are employed separately or in combination as part of an exercise regimen. Nonetheless, resistance training through the use of barbells remains the mainstream for many exercise-conscious individuals. However, current designs of conventional barbells fail to allow one to train in or at an optimum anatomical position in relation to earth's gravitational field. Such proverbial problem has resulted in painful muscle strain and injury.

Accordingly, a need has arisen for a barbell apparatus which facilitates correct vertical spine and shoulder positioning relative to the gravitational field, thereby allowing one to undergo resistance training in an optimum anatomical posture. Consequently, utilization of the present invention not only facilitates maximum benefit when performing weight training exercises, but also serves to avoid injury. The development of the adjustable body circumfusion barbell with off-centerline countermoment and rotating grip fulfills this need.

A search of the prior art did not disclose any patents that read directly on the claims of the instant invention; however, the following references were considered related:

| U.S. Pat. No. | Inventor | Issue Date |
|---|---|---|
| 6,142,918 | Liu | Nov. 7, 2000 |
| 6,196,951 | Shepherd | Mar. 6, 2001 |
| 5,741,206 | Anastasi | Apr. 21, 1998 |
| Des. 437,015 | Rojas et al. | Jan. 30, 2001 |
| 6,228,002 | Dantolan | May 8, 2001 |
| 5,674,162 | Ellingson et al. | Oct. 7, 1997 |
| 6,022,300 | Hightower | Feb. 8, 2000 |

Consequently, a need has been felt for providing an adjustable body circumfusion barbell with off-centerline moment and rotating grip in a manner which is quick, easy, and efficient.

SUMMARY OF THE INVENTION

Therefore, it is an object of the present invention to provide an adjustable, body circumfusion barbell with off-centerline moment for facilitating correct anatomical relationships and positioning so as to allow one to weight train in an optimum anatomical position.

It is another object of the present invention to provide an intermediate moment segment which forms a window for accommodating the torso of a user.

It is another object of the present invention to provide a laterally adjustable trave slidably mounted between a pair of extension members and positioned in an offset parallel manner with respect to a pair of rotating, knurled hand grips.

It is another object of the present invention to provide a locking adjustment assembly for facilitating selected, lockable adjustment of the trave.

It is another object of the present invention to provide the intermediate moment segment being resistant to rotational movement upon elevation and lowering of the body circumfusion barbell with off-centerline moment when performing weight training exercises.

It is another object of the present invention to provide an apparatus which allows one's body to remain in an optimally structured position in relation to the earth's gravitational field, thereby not only facilitating maximum benefit when performing weight training exercises, but also averting injury.

It is another object of the present invention to provide a countermoment weight supporting means having the same diameter as an Olympic style barbell.

It is another object of the present invention to provide a portable apparatus capable of being easily transported via a carrying case or the like.

Briefly described according to one embodiment of the present invention, an adjustable, body circumfusion barbell with off-centerline moment and rotating grip is provided which includes a bar defining a first countermoment end, an intermediate moment segment, and a second countermoment end. The first countermoment end has a weight supporting means having a same diameter as an Olympic style barbell. The first countermoment end further having a first rotating, knurled hand grip rotatably mounted in a perpendicular manner to a lower end of an upright member in an offset parallel manner with respect to weight supporting means via a first axle member, and wherein first axle member is perpendicularly mounted to a first extension member.

The intermediate moment segment includes a linearly elongated, circular trave perpendicularly mounted between lower ends of the first and a second extension member, wherein the intermediate moment segment provides a window for accommodating a user's torso.

The second countermoment end includes a second rotating, knurled hand grip rotatably mounted via second axle member to an upper end of the second extension member, and wherein second axle member having an opposite end perpendicularly mounted to a lower end of an upright member. The second countermoment end further having a weight supporting means with a same diameter as an Olympic style barbell.

The use of the present invention facilitates correct anatomical relationships and positioning which allows one to weight train in an optimum anatomical position, thereby not only facilitating maximum benefit when performing weight training exercises, but also averting injury.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
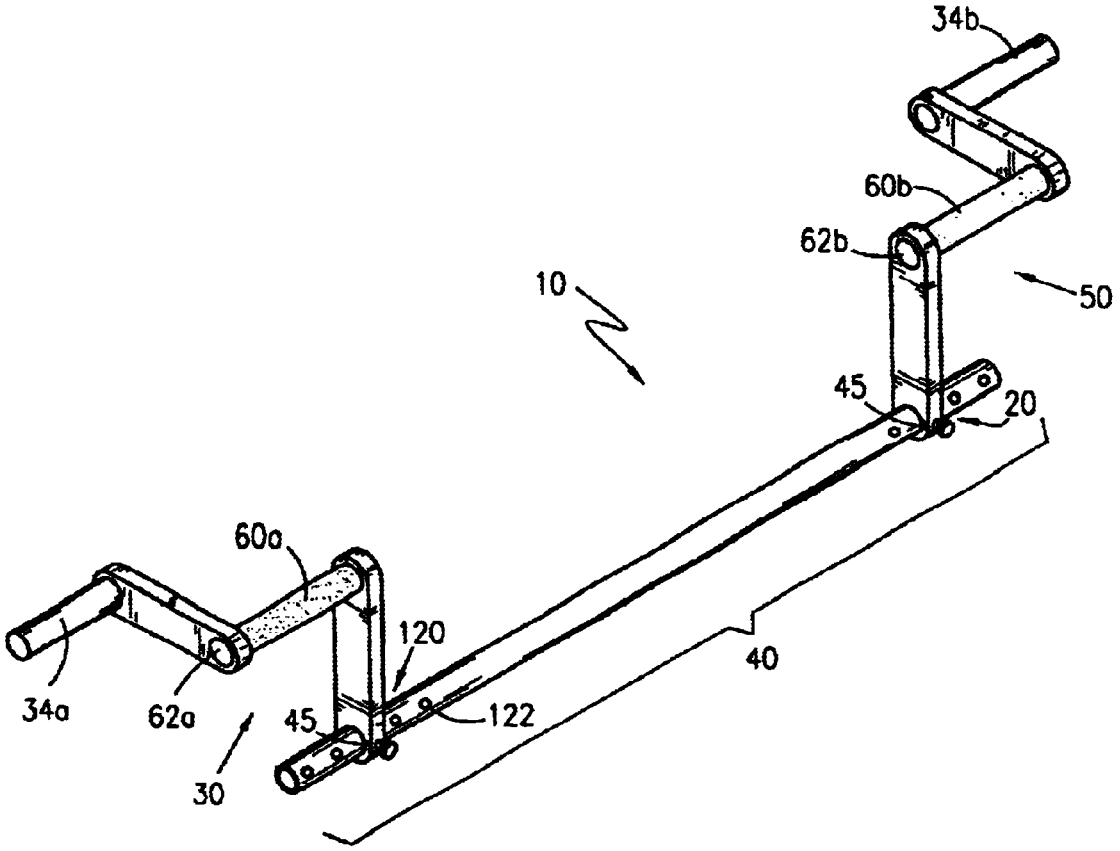
FIG. 1 is a perspective view of an adjustable, body circumfusion barbell with off-centerline moment and rotating grip according to the preferred embodiment of the present invention.
Figure 2:
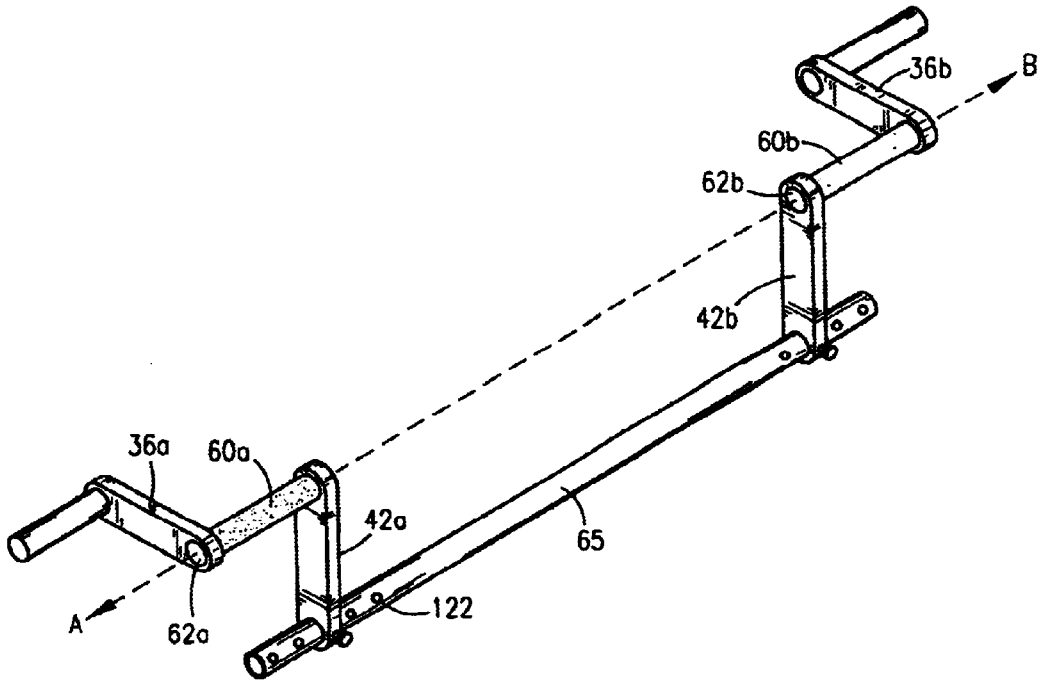
FIG. 2 is a front perspective view thereof.
Figure 3:
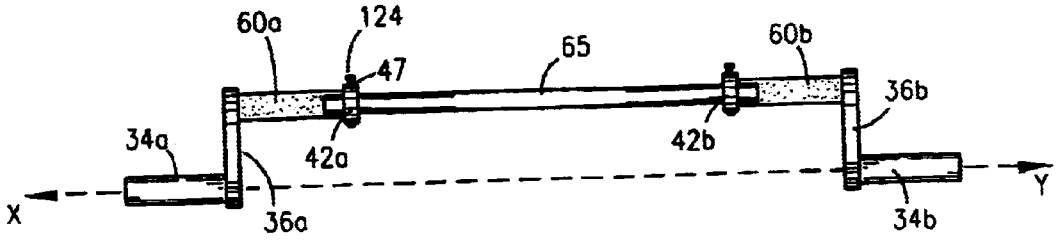
FIG. 3 is a front elevational view thereof.
Figure 4:
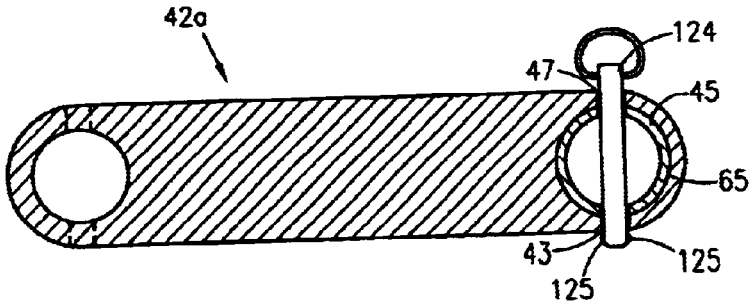
FIG. 4 is a cross-sectional view of the first extension member showing ringed-pin inserted therethrough.
Figure 5:
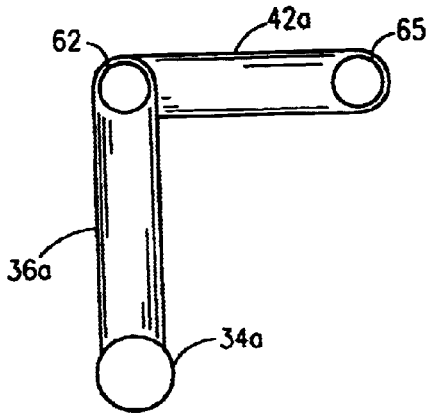
FIG. 5 is a side elevational view of the adjustable, body circumfusion barbell with off-centerline moment and rotating grip according to the preferred embodiment of the present invention.

Referring now to FIGS. 1–5, an adjustable, body circumfusion barbell with off-centerline moment and rotating grip 10 is shown, according to the present invention, comprised of a bar 20 defining a first countermoment end 30, an intermediate moment segment 40, and a second countermoment end 50. The first countermoment end 30 has a weight supporting means which includes a first weight-supporting sleeve 34*a* fabricated of a solid round stock of steel having a same diameter as an Olympic style barbell. An Olympic style barbell is defined as having a plate-bearing diameter of 2.00 inches. The first weight-supporting sleeve 34*a* is perpendicularly mounted to a lower end of an elongated, generally prolate first upright member 36*a* along an outer lateral sidewall thereof.

A first rotating, knurled hand grip 60*a* is perpendicularly mounted to an upper end of the upright member 36*a* along an inner lateral sidewall thereof in an offset parallel manner with respect to supporting sleeve 34*a* via a first axle member 62*a*. The first axle member 62*a* facilitates substantially frictionless rotational movement by knurled hand grip 60*a* when performing exercises thereby allowing for moment countermoment action and also providing for the prevention of forearm, wrist, hand, and elbow tendinitis while also deriving maximum benefit.

The intermediate moment segment 40 includes a linearly elongated, adjustable, circular trave 65 (the function of which to be described later) slidably mounted in a perpendicular manner between forward ends of a first and second extension member 42*a*, 42*b*, respectively, wherein the trave 65 is positioned in an offset parallel manner, and along a same horizontal plane with respect to knurled hand grip 60*a*.

The first and second extension members 42*a*, 42*b* are defined as having an elongated, generally prolate shape, and wherein first extension member 42*a* has a rearward end along an outer lateral sidewall thereof perpendicularly mounted to an end of first axle member 62*a*. Forward ends of the first and second extension members 42*a*, 42*b*, respectively include a portal 45 for slidably receiving the trave 65 therethrough. A rearward end of the second extension member 42*b*, along an outer lateral sidewall thereof, is mounted to the second countermoment end 50 of the bar 20, as will be described in greater detail below.

The intermediate moment segment 40 further provides a window 70 being laterally adjustable so as to accommodate users of various torso sizes. Lateral adjustability of the window 70 is accomplished via a locking adjustment assembly 120. The locking adjustment assembly 120 is designed so as to cooperate with a plurality of holes 122, two sets, being aligned in series along opposing ends of the trave 65. Each of the plurality of holes 122 extends fully through the trave 65. The adjustment assembly 120 includes a pair of ringed-pins 124, wherein each ringed-pin 124 has a pair of opposed detents 125 residing in a lower end thereof.

In order to lock the trave 65 at a selected width, desired holes 122 are chosen and vertically aligned with hole 47 formed in the forward end of both the first and second extension members 42*a*, 42*b* along upper sidewalls thereof. The ringed-pins 124 are then inserted through respective holes 47 of first and second extension members 42*a*, 42*b*, through respective holes 122 in trave 65, and exit first and second extension members 42*a*, 42*b* through holes 47. Upon exiting the first and second extension members 42*a*, 42*b*, the detents 125 of each ringed-pin 124 protrude outward so as to be placed in mechanical interference with a lower ledge 43 of each respective extension member 42*a*, 42*b*, thereby facilitating lockage of the trave 65 at the selected width. Retraction of each ringed-pin 124 permits the trave 65 to slide laterally through respective portals 45 of first and second extension members 42*a*, 42*b*, thus in effect, allowing for first and second extension members 42*a*, 42*b* to slide axially inward and outward. As such, a width of the window 70 is mechanically adjustable so as to accommodate users of various torso sizes. The locking means described herein for facilitating lateral adjustment of window 70, namely the locking adjustment assembly 120, is meant merely as a suggestion, and is not intended to be a limiting factor. It is envisioned that the window 70 is laterally adjustable from a retracted width measuring approximately 9 inches to a fully protracted or extended width measuring approximately 21 inches, thereby providing a lateral adjustment range of approximately 12 inches. Lateral adjustment of the window 70 is defined as a measurable distance between first extension member 42*a* and second extension member 42*b*.

The second countermoment end 50 includes a second rotating, knurled hand grip 60*b* rotatably mounted via second axle member 62*b* to a rearward end of the second extension member 42*b* in a perpendicular manner, along an outer lateral sidewall thereof, and linearly aligned with respect to an axis of rotation represented by AB. The second axle member 62*b* facilitates substantially frictionless rotational movement by knurled hand grip 60*b* when performing exercises.

A second upright member 36*b*, of an elongated, generally prolate configuration, has an upper end along an inner lateral sidewall thereof perpendicularly mounted to an end of the second axle member 62*b*, being opposite its attachment to second extension member 42*b*.

A second weight-supporting sleeve 34*b*, fabricated of a solid round stock of steel and having a same diameter as an Olympic style barbell, is perpendicularly mounted to a lower end of the second upright member 36*b* along a lateral outer sidewall thereof. The second weight-supporting sleeve 34*b* is designed and configured so as to be parallel with respect to axis of rotation AB.

Figure 6:
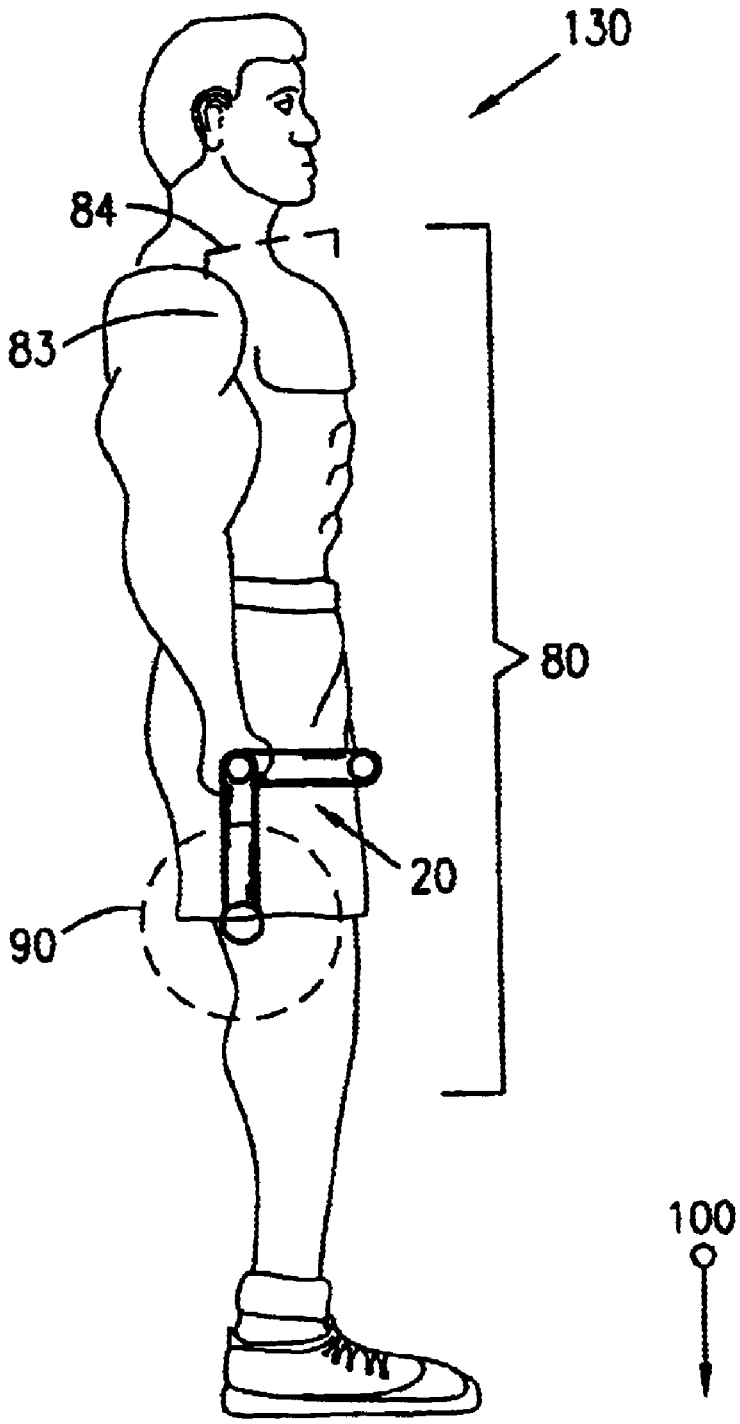
FIG. 6 is a side elevational view of the adjustable, body circumfusion barbell with off-centerline moment and rotating grip shown in-use, illustrating the starting position according to the preferred embodiment of the present invention.
Figure 7:
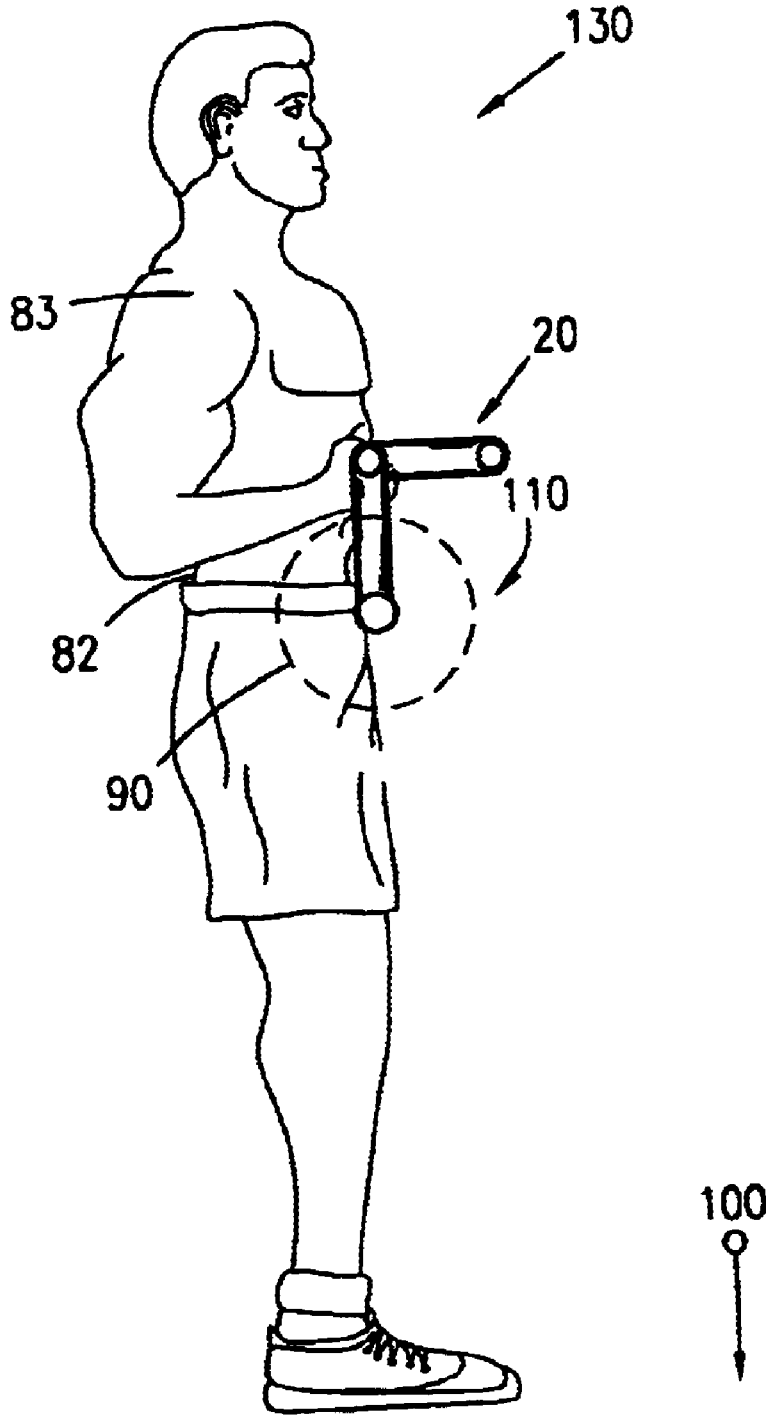
FIG. 7 is a side elevational view of the adjustable, body circumfusion barbell with off-centerline moment and rotating grip shown in-use, illustrating the intermediate position according to the preferred embodiment of the present invention.
Figure 8:
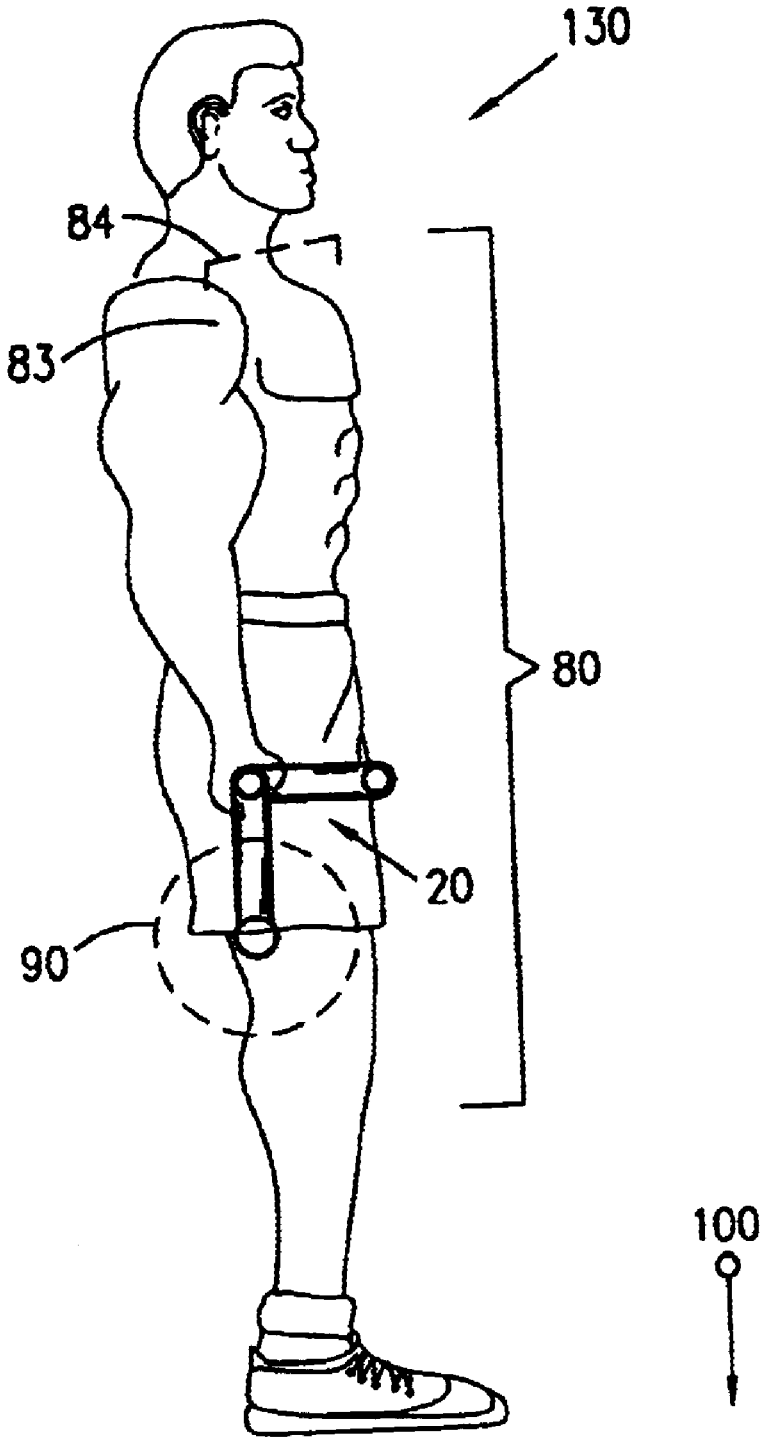
FIG. 8 is a side elevational view of the adjustable, body circumfusion barbell with off-centerline moment and rotating grip shown in-use, illustrating the finished position according to the preferred embodiment of the present invention.

The design and configuration of the adjustable, body circumfusion barbell with off-centerline moment and rotating grip 10 imparts important functional utility; namely, utilization of the present invention facilitates correct anatomical relationships and positioning which allows one to weight train in an optimum anatomical position. When using conventional barbells as taught in the prior art to curl weight 90, the torso's 80 natural tendency is to urge forward in response to pulling weight 90 upward against earth's gravitational pull (see direction arrow 100), thus making the lower lumbar region of the back 82, and frontal shoulder region 83 susceptible to improper muscle strain or injury. Such proverbial problem has been overcome by the unique design and configuration of the intermediate moment segment 40 and its syntactic relationship with associated elements, whereby the user's back 82 and shoulder girdle 84 are easily maintained in a proper vertical position when performing, for example, the biceps curl exercise. More specifically, the syntactic relationship between the elements of the present invention place one's body in an optimally structured position in relation to the earth's gravitational field, thereby not only facilitating maximum benefit when performing weight training exercises, but also averting injury. To more adequately describe, when performing the biceps curl exercise 130, as shown in FIGS. 6–8, the intermediate moment segment 40 provides a window 70 for accommodating user's torso 80. The window 70 is laterally adjustable via the locking adjustment assembly 120 so as to sizably accommodate a particular user's torso. In a starting position, as shown in FIG. 6, the torso 80 resides within such window 70 while upright members 36*a*, 36*b* are in vertical alignment with user's torso 80. Upon elevation of the bar 20 to an intermediate position, as shown in FIG. 7, the upright members 36*a*, 36*b* remain in such vertical alignment.

Referring now to FIG. 8, to complete the biceps curl exercise 130, the bar 20 is lowered following the same vertical path traveled when elevating the bar 20 to the intermediate position.

Further, the design and configuration of the first countermoment end 30 and second countermoment end 50 is resistant to rotational movement, as depicted by direction arrow 110, whereby such rotational movement is generated by mass of the intermediate moment segment 40 upon elevation and lowering of the adjustable, body circumfusion barbell with off-centerline moment and rotating grip 10 when performing the biceps curl exercise 130. The window 70 is counterbalanced via the weight 90, thus preventing undesired rotational movement 110 thereby.

Figure 9:
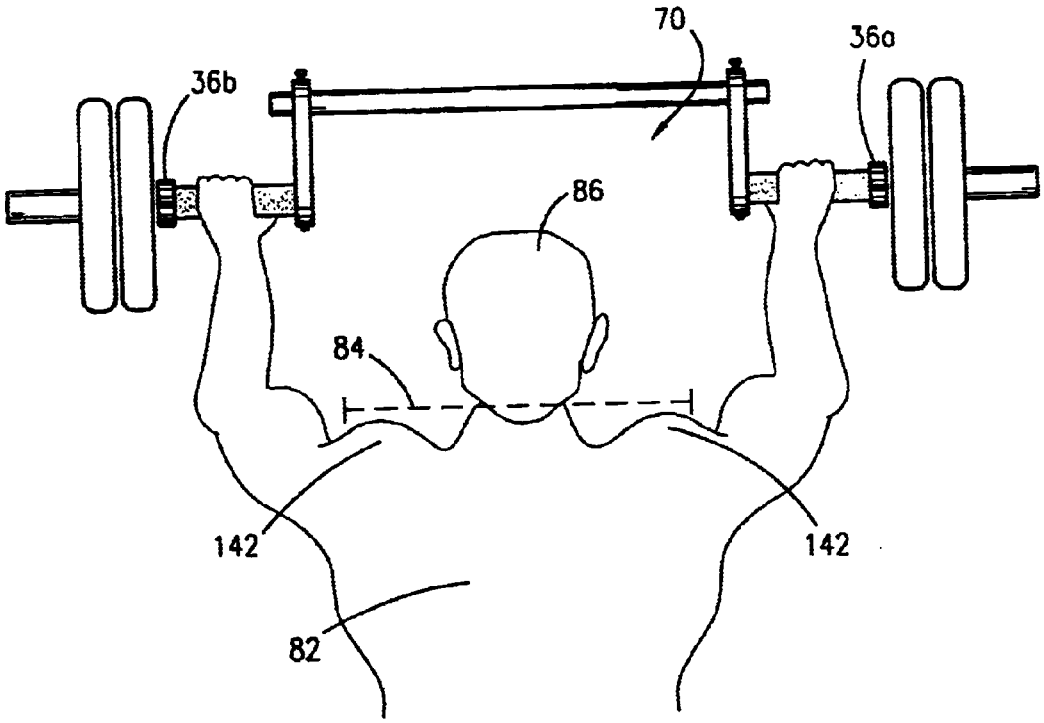
FIG. 9 is a rear elevational view of the adjustable, body circumfusion barbell with off-centerline moment and rotating grip shown in-use while performing an overhead shoulder press exercise.

It is envisioned that the adjustable, body circumfusion barbell with off-centerline moment and rotating grip 10 can be incorporated for use when performing an overhead shoulder press exercise 140, as shown in FIG. 9. When performing such exercise, the window 70 of the intermediate moment segment 40 provides for total clearance of user's head 86. Upon descension and ascension of the bar 20, upright maintenance of the user's back 82 and shoulder girdle 84 in proper vertical position is facilitated when performing such exercise. Undesired forward or rearward leaning of the head 86 usually resulting in painful muscle strain is effectively eliminated. In addition, because descension and ascension of the bar 20 remains in perfect linear alignment with user's back 82 during performance of the aforementioned exercise, a more direct and powerful contraction by the deltoid muscles 142 are realized, thus allowing the user to derive the maximum benefit when performing the overhead shoulder press exercise.

It is envisioned that the present invention may be utilized for performing numerous other weight training exercises including, but not limited to shoulder shrugs, upright rows, bent-over rows, reverse bar shrugs, power cleans, and deadlifts.

2. Operation of the Preferred Embodiment

While the present invention can be utilized for performing numerous weight training exercises, as a non-limiting example, the biceps curl exercise is selected for illustrative purposes in order to describe proper operation of the present invention. First, user places a desired amount of weight 90 onto each weight-supporting sleeve 34*a*, 34*b*. User laterally adjusts the trave 65 via the locking adjustment assembly 120 so as to provide a window 70 which properly accommodates user's torso. While bending at the knees, user firmly grasps rotating, knurled hand grips 60*a*, 60*b* in each hand, and slowly rises to a standing position. User then places his torso within the window 70 of the intermediate moment segment 40. In the starting position, shown in FIG. 6, with arms extended, user curls the bar 20 in an upward manner to an intermediate position, as shown in FIG. 7, while simultaneously keeping hands moving in a vertically aligned manner with respect to his torso 80. User then slowly lowers the bar 20 to a finished position as shown in FIG. 8 by following the same vertical path traveled when elevating the bar 20 to the intermediate position.

The use of the present invention facilitates correct anatomical relationships and positioning which allows one to weight train in an optimum anatomical position, thereby not only facilitating maximum benefit when performing weight training exercises, but also averting injury.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be broadly limited only by the following Claims.

What is claimed is:

1. A body circumfusion barbell with off-centerline moment comprising:

a first countermoment end, said first countermoment end has a weight supporting means defined as a first weight-supporting sleeve fabricated of a solid round stock of steel having a same diameter as an Olympic style barbell, said first weight-supporting sleeve being perpendicularly mounted to a lower end of an elongated, generally prolate first upright member along an outer lateral sidewall of said first upright member;

said first countermoment end includes a first rotating, knurled hand grip perpendicularly mounted via a first axle member to an upper end of said first upright member along an inner lateral sidewall of said first upright member in an offset parallel manner relative to said first weight-supporting sleeve, said first axle member facilitates substantially frictionless rotational movement by said first rotating, knurled hand grip when performing exercises, thereby preventing the onset of tendonitis while also deriving maximum benefit;

an intermediate moment segment, said intermediate moment segment comprising a first extension member joined to said first countermoment end and having an elongated, generally prolate shape and a second extension member having an elongated, generally prolate shape;

said first extension member has a rearward end along an outer lateral sidewall thereof perpendicularly mounted to an end of said first axle member;

a second countermoment end joined to said second extension member, said second countermoment end has a weight supporting means defined as a second weight-supporting sleeve fabricated of a solid round stock of steel having a same diameter as an Olympic style barbell, said second weight-supporting sleeve being perpendicularly mounted to a lower end of an elongated, generally prolate second upright member along an outer lateral sidewall of said second upright member; and a locking adjustment assembly for selecting the relative positions of said first and second extension members with respect to each other.

2. The body circumfusion barbell with off-centerline moment of claim 1, wherein said second countermoment end includes a second rotating, knurled hand grip rotatably mounted via a second axle member to a rearward end of said second extension member in a perpendicular manner, along an outer lateral sidewall of said second extension member, said second axle member facilitates substantially frictionless rotational movement by said second rotating, knurled hand grip when performing exercises.

3. The body circumfusion barbell with off-centerline moment of claim 2, wherein said second upright member has an upper end along an inner lateral sidewall thereof perpendicularly mounted to an end of said second axle member being opposite to said second axle member's attachment to said second extension member.

4. The body circumfusion barbell with off-centerline moment of claim 1, wherein said intermediate moment segment includes a linearly elongated, adjustable, circular trave slidably mounted in a perpendicular manner between a forward end of said first extension member and of said second extension member, wherein said trave is positioned in an offset parallel manner, and along a same horizontal plane with respect to said first rotating, knurled hand grip and said second rotating, knurled hand grip thereby forming a window for accommodating users of various torso sizes.

5. The body circumfusion barbell with off-centerline moment of claim 4, wherein said forward end of said first extension member defines a portal for slidably receiving said trave therethrough.

6. The body circumfusion barbell with off-centerline moment of claim 5, wherein said trave has a plurality of holes aligned in series along opposing ends of said trave, and wherein each hole of said plurality of holes extends fully through said trave.

7. The body circumfusion barbell with off-centerline moment of claim 4, wherein said forward end of said second extension member defines a portal for slidably receiving said trave therethrough.

8. The body circumfusion barbell with off-centerline moment of claim 4, wherein said intermediate moment segment is designed and configured as having a syntactic relationship with associated elements whereby user's back and shoulder girdle are easily maintained in a proper vertical position when performing weight training exercises, such that upon elevation and lowering of said body circumfusion barbell with off-centerline moment, said window is counterbalanced by weight, thus preventing undesired rotational movement generated by mass of said intermediate moment segment upon elevation and lowering of said body circumfusion barbell with off-centerline moment, and in turn preventing improper muscle strain or injury to a lower lumbar region of back and to a frontal shoulder region.

9. The body circumfusion barbell with off-centerline moment of claim 4, wherein said locking adjustment assembly includes a pair of ringed-pins, wherein each ringed-pin of said pair of ringed-pins has a pair of opposed detents residing in a lower end thereof, said pair of ringed-pins each extending through a respective hole formed in said forward end of said first extension member and of said second extension member along an upper sidewall of said first extension member and of said second extension member, said pair of ringed-pins further extending through selected holes of said trave and exit said first extension member and said second extension member, whereby said detents of each of said pair of ringed-pins protrude outward so as to be placed in mechanical interference with a lower ledge of said first extension member and of said second extension member, thereby facilitating lockage of said trave at selected width.

10. The body circumfusion barbell with off-centerline moment of claim 4, wherein said window is laterally adjustable over a range of approximately 12 inches, said range defined as a measurable distance between said first extension member and said second extension member.

11. A method of performing a biceps curl exercise utilizing an adjustable, body circumfusion barbell with off-centerline moment and rotating grip, comprising the steps of:

(1) placing a desired amount of weight onto each weight-supporting sleeve;

(2) adjusting a trave via a locking adjustment assembly so as to provide a window being adaptive to user's torso;

(3) bending at the knees and firmly grasping first and second rotating, knurled hand grips;

(4) rising slowly to a standing position;

(5) placing torso within said window;

(6) curling said body circumfusion barbell in an upward manner to an intermediate position, while simultaneously keeping hands moving in a vertically aligned manner with respect to user's torso;

(7) lowering slowly said body circumfusion barbell to a finished position by following a same vertical path traveled in step (6), thus facilitating correct anatomical relationships and positioning relative to earth's gravitational field which allows one to weight train in an optimum anatomical position, thereby not only facilitating maximum benefit when performing said biceps curl exercise, but also averting injury; and (8) repeating steps (6) and (7) for a desired number of repetitions.

* * * * *